United States Patent [19]

Christie

[11] Patent Number: 5,066,535

[45] Date of Patent: Nov. 19, 1991

[54] FABRIC PATTERNING PROCESS AND PRODUCT

[75] Inventor: Wesley D. Christie, Inman, S.C.

[73] Assignee: Milliken Research Corporation, Spartanburg, S.C.

[21] Appl. No.: 560,465

[22] Filed: Jul. 25, 1990

Related U.S. Application Data

[63] Continuation of Ser. No. 478,057, Feb. 7, 1990, abandoned, which is a continuation of Ser. No. 406,840, Sep. 13, 1989, abandoned, which is a continuation of Ser. No. 45,105, May 1, 1987, abandoned.

[51] Int. Cl.[5] ..... B05D 5/00; D06P 5/12; D06P 5/20; D06P 7/00

[52] U.S. Cl. ..... 428/196; 8/446; 8/449; 8/455; 8/456; 427/273; 427/331; 428/201

[58] Field of Search ..... 8/446, 449, 455, 456; 427/331, 273; 428/196, 201

[56] References Cited

U.S. PATENT DOCUMENTS

| | | | |
|---|---|---|---|
| Re. 31,601 | 6/1984 | Ikeda et al. | 428/93 |
| 1,862,189 | 6/1932 | McCarthy | 427/273 |
| 2,344,783 | 3/1944 | Munro | 427/273 |
| 2,681,867 | 6/1954 | Miller | 427/273 |
| 2,862,251 | 12/1958 | Kalwaites | 19/161 |
| 3,033,721 | 5/1962 | Kalwaites | 154/46 |
| 3,214,819 | 11/1965 | Guerin | 28/72.2 |
| 3,333,315 | 8/1967 | Dyer et al. | 28/72.2 |
| 3,403,862 | 10/1968 | Dworjanyn | 239/566 |
| 3,434,188 | 3/1969 | Summers | 28/72.2 |
| 3,485,706 | 12/1969 | Evans | 161/72 |
| 3,485,708 | 12/1969 | Ballou et al. | 161/72 |
| 3,485,709 | 12/1969 | Evans et al. | 161/109 |
| 3,486,168 | 12/1969 | Evans et al. | 161/169 |
| 3,493,462 | 2/1970 | Bunting, Jr. et al. | 161/169 |
| 3,494,821 | 2/1970 | Evans | 161/169 |
| 3,508,308 | 4/1970 | Bunting, Jr. et al. | 28/72.2 |
| 3,546,755 | 12/1970 | Lynch | 28/72.2 |
| 3,560,326 | 2/1971 | Bunting, Jr. et al. | 161/169 |
| 3,616,175 | 10/1971 | Jung | 161/164 |
| 3,620,903 | 11/1971 | Bunting, Jr. et al. | 161/169 |
| 3,688,355 | 9/1972 | Okzaki et al. | 28/1.4 |
| 3,750,237 | 8/1973 | Kalwaites | 19/161 P |
| 3,768,121 | 10/1973 | Kalwaites | 19/161 P |
| 3,769,659 | 11/1973 | Kalwaites | 19/161 P |
| 3,787,932 | 1/1974 | Kalwaites | 19/161 P |
| 3,800,364 | 4/1974 | Kalwaites | 19/161 P |
| 3,837,046 | 9/1974 | Kalwaites | 19/161 P |
| 3,873,255 | 3/1975 | Kalwaites | 425/83 |
| 4,024,612 | 5/1977 | Contractor et al. | 28/72.2 F |
| 4,069,563 | 1/1978 | Contractor et al. | 28/105 |
| 4,085,485 | 4/1978 | Brandon et al. | 28/104 |
| 4,146,663 | 3/1979 | Ikeda et al. | 428/96 |
| 4,228,123 | 10/1980 | Marshall | 264/557 |
| 4,291,072 | 9/1981 | Barrett et al. | 427/273 |
| 4,329,763 | 5/1982 | Alexander et al. | 28/104 |
| 4,368,227 | 1/1983 | Setsuie et al. | 428/91 |
| 4,410,579 | 10/1983 | Johns | 428/131 |
| 4,426,420 | 1/1984 | Likhyani | 428/224 |
| 4,442,161 | 4/1984 | Kirayoglu et al. | 428/219 |
| 4,453,298 | 6/1984 | Nabulon et al. | 28/255 |
| 4,582,666 | 4/1986 | Kenworthy et al. | 264/557 |
| 4,591,513 | 5/1986 | Suzuki et al. | 427/200 |
| 4,665,597 | 5/1987 | Suzuki et al. | 28/104 |
| 4,695,422 | 9/1987 | Curro et al. | 264/504 |
| 4,718,152 | 1/1988 | Suzuki et al. | 28/104 |
| 4,743,483 | 5/1988 | Shimizu et al. | 428/89 |

FOREIGN PATENT DOCUMENTS

| | | |
|---|---|---|
| 287821 | 9/1964 | Australia . |
| 0210777 | 2/1987 | European Pat. Off. . |
| 0288197 | 7/1987 | European Pat. Off. . |
| WO89/09850 | 10/1989 | PCT Int'l Appl. . |
| WO89/10441 | 11/1989 | PCT Int'l Appl. . |
| 952819 | 3/1964 | United Kingdom . |
| 1063252 | 3/1967 | United Kingdom . |
| 1101899 | 1/1968 | United Kingdom . |
| 1380071 | 1/1975 | United Kingdom . |

OTHER PUBLICATIONS

Kenneth R. Randall, "Hydroentanglement Technology For Wet-Laid Applications," *Nonwovens World*, Mar. 1989, pp. 28–31.

*Primary Examiner*—James C. Cannon

*Attorney, Agent, or Firm*—Kevin M. Kercher; H. William Petry

[57] ABSTRACT

A method for patterning a textile fabric in which a hydrophobic composition is uniformly applied to the surface of the fabric, and the resulting product. A high velocity water stream is used to wet areas of the fabric comprising the pattern areas. An aqueous dye is then applied uniformly to the fabric. The unfixed dye is retained by the fabric in those areas wetted by the water stream, the fabric is then treated to fix the retained dye.

8 Claims, 14 Drawing Sheets

FABRIC PATTERNING PROCESS AND PRODUCT

This is a continuation of application Ser. No. 478,057 filed Feb. 7, 1990 and now abandoned which is a continuation of application Ser. No. 406,840 filed Sept. 13, 1989 and now abandoned which is a continuation of application Ser. No. 045,105 filed May 01, 1987, now abandoned.

This invention relates to a method for generating a novel pattern-dyed textile product having a batik-like appearance, and to the resulting product. In particular, this invention relates to a process whereby a water repellent agent is applied uniformly to a fabric which is then selectively wet by a high velocity water stream in selected areas to be dyed. Subsequent dyeing with an aqueous dye results in dye being retained only in the areas wetted by the water stream.

The textile industry is constantly searching for commercially practical methods by which textile fabrics, especially fabrics suitable for apparel or decorative interior use, may be patterned, textured, or otherwise made more attractive. Of particular interest are economical methods by which (1) standard fabrics may be made to look and/or feel like more attractive and expensive fabrics, or (2) standard fabrics may be transformed into unusual fabrics having attractive or desirable characteristics not available in any other fabric.

Of particular interest are methods in which the surface appearance of a fabric is modified, and in which (1) a variety of different pattern effects may be generated, depending upon process conditions and the nature of the fabric being patterned;

(2) the desired effects or characteristics may be imparted to the fabric in a highly controlled, reproducible manner yet may be modified or changed quickly, with a minimum of lost production time or expense;

(3) the speed and cost of generating such effects or characteristics makes the method commercially economical; and (4) the generation of such effects may be controlled electronically to eliminate such conventional concerns as repeat length, complexity of pattern, minimum economical run length, and fabric waste between pattern changes.

The process of the instant invention provides all the above advantages.

The traditional batik process for textile fabric dyeing involves selectively applying to the undyed fabric surface, in a pattern corresponding to those areas in which dye is to be excluded, a wax or other resist material which will prevent the penetration of liquid dye in the pattern area. Following this step, the fabric is immersed or otherwise brought into contact with the selected liquid dye. The dye penetrates the yarns in those areas of the fabric not covered by the resist material, but is prevented from penetrating those yarns in the areas covered by the resist material. After a drying step, the wax or other resist material is removed by chemical or other means. The resulting fabric exhibits a dyed pattern which is the negative or inverse of the pattern in which the resist material was applied.

By repeating the process, and perhaps by subjecting the same fabric areas to multiple applications of the same or different dyes (e.g., applying the resist to the same areas in successive dyeing steps) a variety of dye patterns and colors may be achieved. If a water-resistant finish is desired, the finish is applied after all dyeing steps are complete. The resulting fabric has a characteristic and distinctive look which is associated with handmade fabrics and apparel, and which has considerable commercial appeal.

The process described hereinbelow produces a batik-like pattern which rivals the look of fabrics patterned using traditional methods, but which may be controlled electronically, and which may be generated at speeds comparable to or faster than other commercially useful pattern dyeing systems.

In accordance with the present invention, the fabric to be patterned is first uniformly treated with a water repelling material, preferably a fluorocarbon composition such as a Scotchguard product, marketed by the 3M Company of St. Paul, Minn. in accordance with the manufacturer's instructions. Following this treatment, the fabric surface is selectively subjected to one or more streams of a high velocity liquid, preferably water, applied to the fabric surface in a pattern configuration which corresponds to the areas to be dyed. The water streams have sufficient energy to wet the individual yarns in the pattern area, even though the yarns have been treated with a water repelling agent. Generally, areas of the fabric not directly impacted by water streams of the correct pressure tend to be not wetted by the surrounding water and retain their hydrophobic character. It is believed that the water streams not only "force" the yarns to wet by overcoming, due to the high stream velocities used, the hydrophobic nature of the finish, but also remove a quantity of the finish from the yarns directly impacted by the streams, thereby allowing for the temporary wetting of those yarns by the streams. The degree to which the finish is removed is not known with precision; certainly sufficient quantities of the finish remain in the impacted areas to provide a substantially intact water-resistant finish capable of causing the dried fabric to resist wetting over the entire fabric surface. Qualitative testing and analysis suggests that at least about 40 to 50 percent of the hydrophobic finish remains after being subjected to a single high velocity spray treatment at about 600 p.s.i.g. in accordance with the teachings herein. Use of lower pressures are believed to result in a higher percentage of remaining hydrophobic material. If desired, a subsequent, post-dyeing process step may be included wherein the remaining quantities of hydrophobic finish are removed. The selectively wetted fabric is dyed using aqueous dyes by conventional means, e.g., by padding, while the patterned areas of the fabric are still wet. The dye is absorbed in the wetted patterned areas, but is substantially rejected elsewhere due to the hydrophobic character of the water repellent composition present in those areas not impacted, and therefore not wetted, by the high velocity water streams. The resulting dyed fabric may then be fixed and dried by conventional means. When dry, the patterned fabric retains a water repellant character over its entire area, including the areas previously wetted by the water streams. In many cases, particularly with fabrics which are readily penetrated by the water streams, the batik pattern is observable on the face and the back of the fabric, although that side of the fabric directly exposed to the water streams will generally appear to pick up and retain slightly more dye than the opposite side of the fabric, and will therefore appear to be dyed more strongly or deeply. Additionally, the fabric may exhibit some structural modification in those areas impacted by the water stream, such as localized changes in the warp yarn spacing or other effects, as will be discussed in more detail below.

As with conventional batik processes, this process may be used repeatedly, using different jet stream impact areas and/or different dyes, to generate a wide variety of patterns and colors. It is also contemplated that the starting fabric may already be dyed a desired uniform background color prior to the application of the water repellent composition.

Further advantages and features of the invention will be come apparent in the discussion hereinbelow, when read in conjunction with the accompanying Figures, in which.

Several approaches contemplated and used by the inventor to generate the products disclosed herein are depicted in FIGS. 1 through 10, and are discussed in more detail below. Alternative approaches, conceived by others and useful for generating the products disclosed herein, are depicted in FIGS. 11 through 17, and are discussed in more detail further below.

Figure 1:
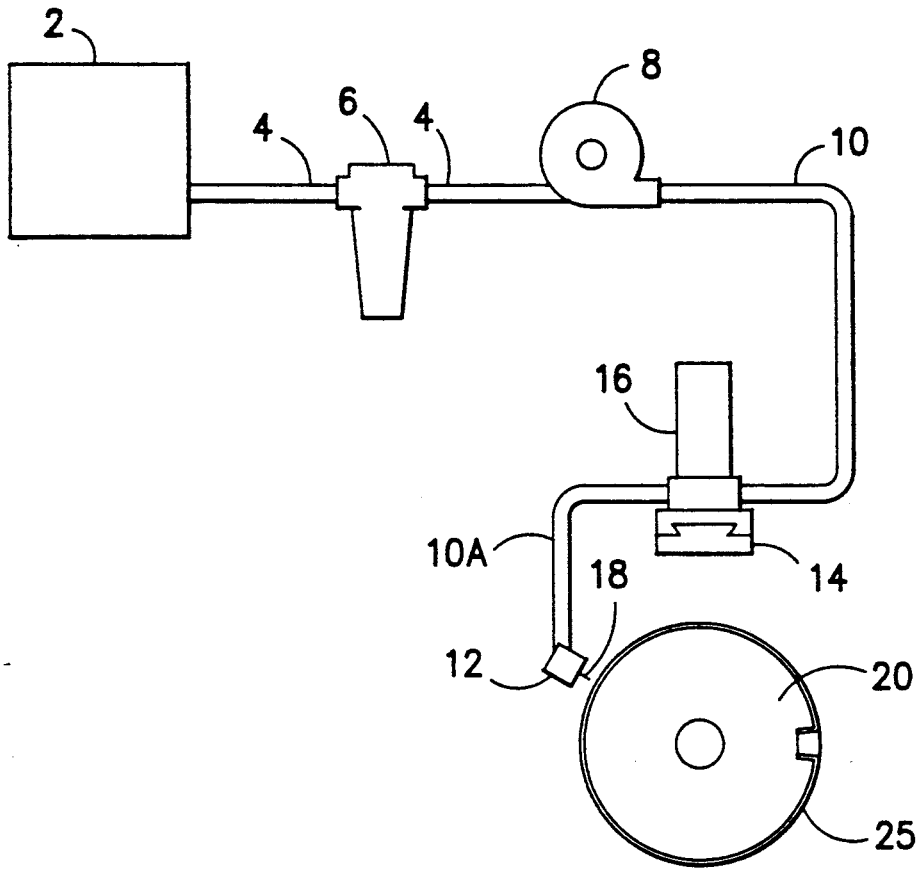
FIG. 1 is schematicized side view of an apparatus for generating the fabric of the instant invention wherein a pre-cut section of fabric is patterned by a traversing liquid jet under solenoid or pneumatic valve control.
Figure 2:
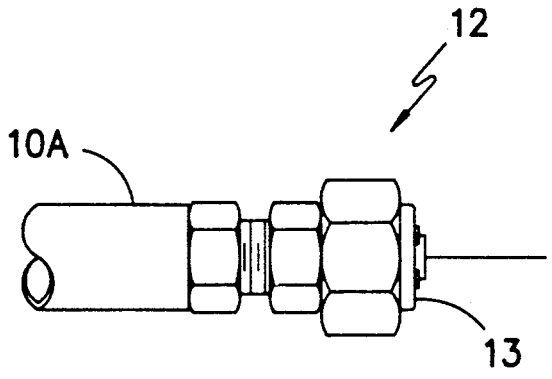
FIG. 2 is a side view of one embodiment of an orifice assembly for a single jet.

FIG. 1 schematically depicts an apparatus which may be used to generate the products of this invention. For purposes of discussion hereinbelow, water will be assumed as the working fluid of choice, although other fluids may be substituted therefore. Pump 8 is a pump capable of pumping the water or other desired working fluid at the desired rate and pressure. If a single liquid stream is used, the pump should be capable of delivering a single stream having a minimum cross-section dimension within the range of about 0.003 inch to about 0.03 inch, at dynamic pressures ranging from about 100 p.s.i.g. to about 1000 p.s.i.g. (i.e., water stream velocities ranging from about 200 f.p.s. to about 667 f.p.s.) although stream sizes and stream pressures (or velocities) outside this range may prove advantageous under certain circumstances. Generally speaking, streams having diameters lying within the range of about 0.007 to about 0.03 inch are preferred. Such streams have a diameter which is generally less than twice as large as the spacing between adjacent yarns in most textile fabrics. Dynamic pressures in excess of about 100 p.s.i.g. are also generally preferred. Generally, pressures substantially lower than about 100 p.s.i.g. are believed to be insufficient to produce a consistently satisfactory and uniform result. Use of increased pressures tends to increase the degree of "background," i.e., dye retention in areas not directly impacted by the water stream, but the degree of such effect depends greatly upon the weight and construction of the fabric being patterned. Use of simultaneous multiple streams, as described hereinafter, will, of course, require increased pump capacity. As indicated in FIG. 1, pump 8 is connected to a source 2 of the desired working fluid, e.g., water, via conduit 4 and filter assembly 6. Filter assembly 6 is intended to remove undesirable particulate matter from the working liquid which could clog the various orifice assemblies discussed in more detail below. The high pressure output of pump 8 is fed, via high pressure conduits 10 and 10A, to high velocity fluid orifice assembly 12. Orifice assembly 12, in simple form, may be merely a suitable termination of conduit 10A having a single orifice of the size which will generate a fluid stream of the desired cross-sectional shape and area, and which will operate safely at the desired pressure, as depicted in FIG. 2. Conduits 10 and 10A may be any suitable conduit capable of safely accommodating the desired fluid pressures and flow rates, and having sufficient flexibility or rigidity to permit orifice assembly 12 to be positioned as desired with respect to the substrate to be treated.

Situated in close proximity to orifice assembly 12 is roll 20, over which the textile fabric to be treated is placed. Generally, roll 20 has a solid, smooth, inflexible surface (e.g., polished aluminum or stainless steel); a roll having a specially treated or formed surface may be useful in achieving certain special effects on selected substrates. It has been found, for example, that use of a contoured roll surface may result in patterning effects corresponding to the roll surface contours on the substrate.

Figure 3:
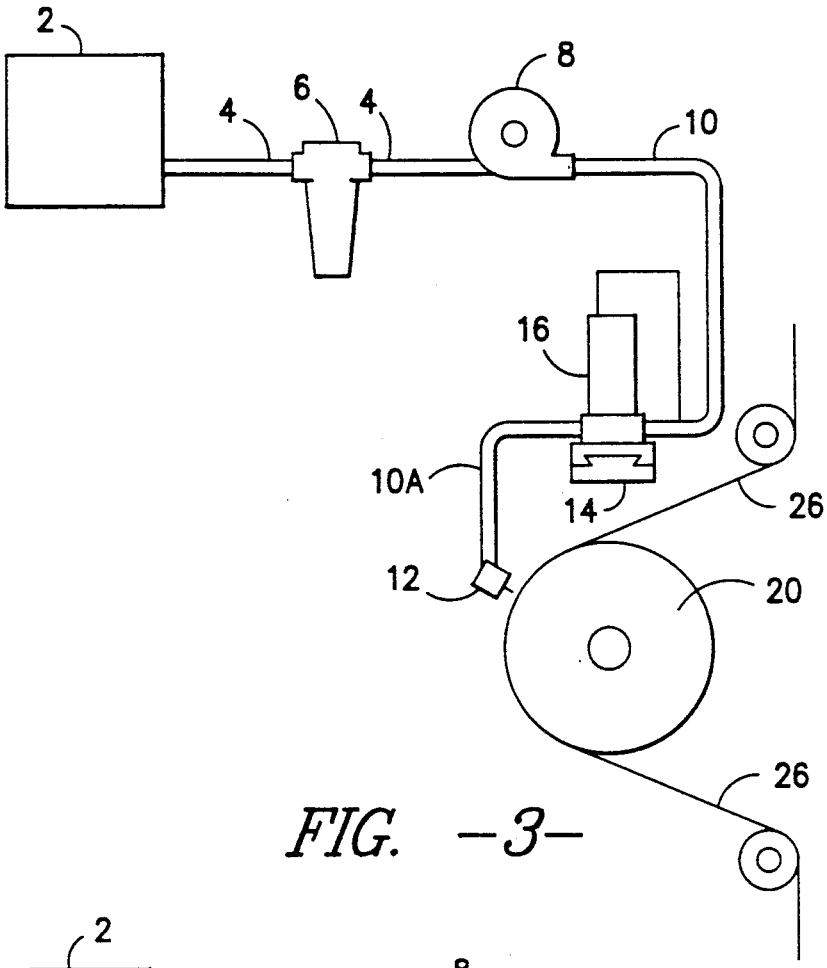
FIG. 3 is a schematicized side view of an apparatus for generating the fabric of the instant invention wherein a continuous web of fabric is patterned by a traversing liquid jet under solenoid or pneumatic valve control.

Associated with roll 20 is textile fabric 25, which may be in the form of a fabric section which is wrapped about the circumference of roll 20 and securely attached at both ends, as depicted in FIG. 1, or which may be in the form of a continuously moving web which is positioned against a portion of roll 20, depicted in, e.g., FIG. 3 at 26.

In order to generate a pattern on textile fabric 25, contact between the fabric and the high velocity stream of fluid emanating from orifice assembly 12 must be established and interrupted in a way which corresponds to the desired length and lateral spacing of the stripes comprising the pattern. Where a solid area is to be treated, the fluid streams may be made to contact the fabric in closely adjacent or overlapping stripes.

FIG. 1 shows a diagrammatic side view of a texturing and patterning system in which an orifice assembly 12, which produces a single high velocity fluid jet 18, is associated with a traversing table 14. Table 14 permits orifice assembly 12 to be moved, in a precisely controlled and reproducible manner, parallel to the axis of roll 20, around which is affixed a section of fabric 25 in the form of a sleeve or a short section of fabric, which is securely fastened at both ends about the circumference of roll 20. Orifice assembly 12 may be constructed by installing a high pressure cap 13 having a single orifice of the proper size on the end of a suitable high pressure conduit 10A, as depicted in FIG. 2. Of course, more elaborate orifice assemblies may be used as well, as will be discussed below.

Associated with conduits 10 and 10A is remotely actuated fluid valve 16, which valve is preferably installed in close proximity to orifice assembly 12 so as to minimize the length of conduit 10A between valve 16 and orifice assembly 12 and the attendant "water hammer" effect. Valve 16 may be actuated electrically, pneumatically, or by other means. In one embodiment, valve 16 comprises an electrical solenoid valve of the type marketed by the Skinner Valve Company, a division of Honeywell, Inc., of Minneapolis, Minn., as Model V52H. This valve may be installed upstream of orifice assembly 12, in a conventional manner such as to control the flow of fluid in conduit 10A.

In operation, a working fluid, e.g., water, is pumped by pump 8 from fluid source 2, through filter means 6, to valve 16. If the portion of fabric 25 directly opposite orifice assembly 12 is to be treated, valve 16 is made to open, e.g., via an electrical or pneumatic command signal, and high pressure water is allowed to pass via conduit 10A to orifice assembly 12, where a thin, high velocity water jet 18 is formed and directed onto the fabric 25. When the desired pattern requires that jet 18 not impact the fabric 25, an appropriate electrically or pneumatically transmitted instruction causes valve 16 to close. Positioning the desired areas of fabric surface under the jet 18 is achieved by proper coordination of rotation of roll 20 and translation of traversing table 14, which preferably may be accomplished by computer control, in conjunction with a rotation sensor mounted in association with roll 20.

Figure 4:
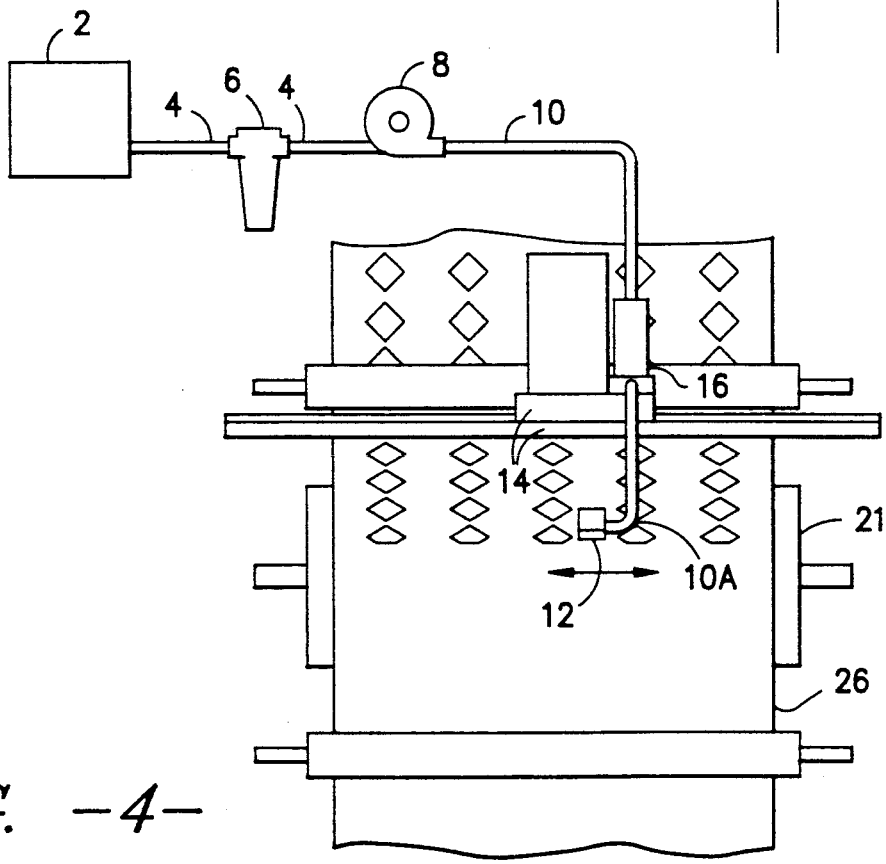
FIG. 4 is a schematicized plan view of the apparatus of FIG. 3.

Assuming that appropriate indicating means are used to specify, via a digital signal, the exact rotational position of roll 20 and lateral position of traversing table 14, a computer may be used to generate on/off instructions to valve 16 in accordance with pre-programmed pattern data. It is contemplated that roll 20 may be made to rotate continuously while traversing table 14 moves relatively slowly, in incremental linear steps, along the axis of the roll, or preferably, roll 20 may be made to move intermittently, while traversing table 14 sweeps across the fabric face for each incremental rotational movement of roll 20. If the latter technique is employed, fabric 25 may be in the form of a web 26 traveling over roll 21, as shown in FIGS. 3 and 4, which better lends itself to commercial production methods.

It should be understood that, if desired, an orifice assembly which can generate a multiple jet array may be substituted for the single jet orifice assembly 12. In most commercial applications, this will comprise a preferred embodiment, particularly if computer control is available to control the actuation of the multiple valves necessary in such system, and will be described below.

Figure 5:
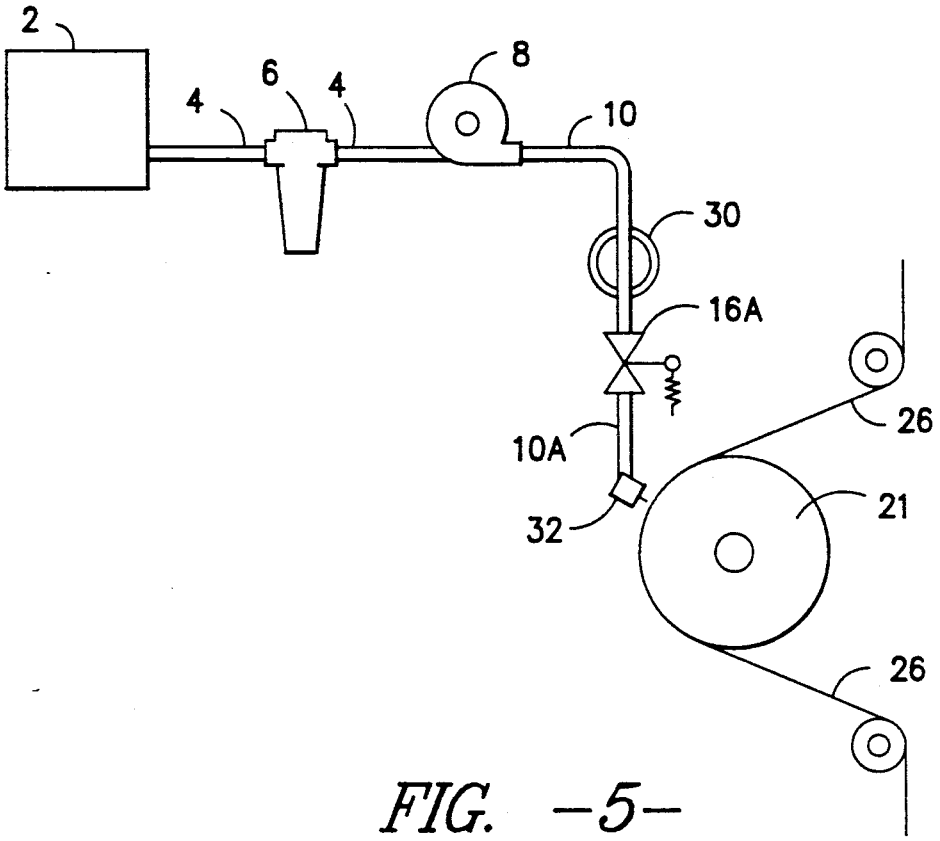
FIG. 5 is schematicized side view of an apparatus for generating the fabric of the instant invention wherein multiple jets, under individual solenoid or pneumatic cylinder control, are used to pattern a web of fabric.
Figure 6:
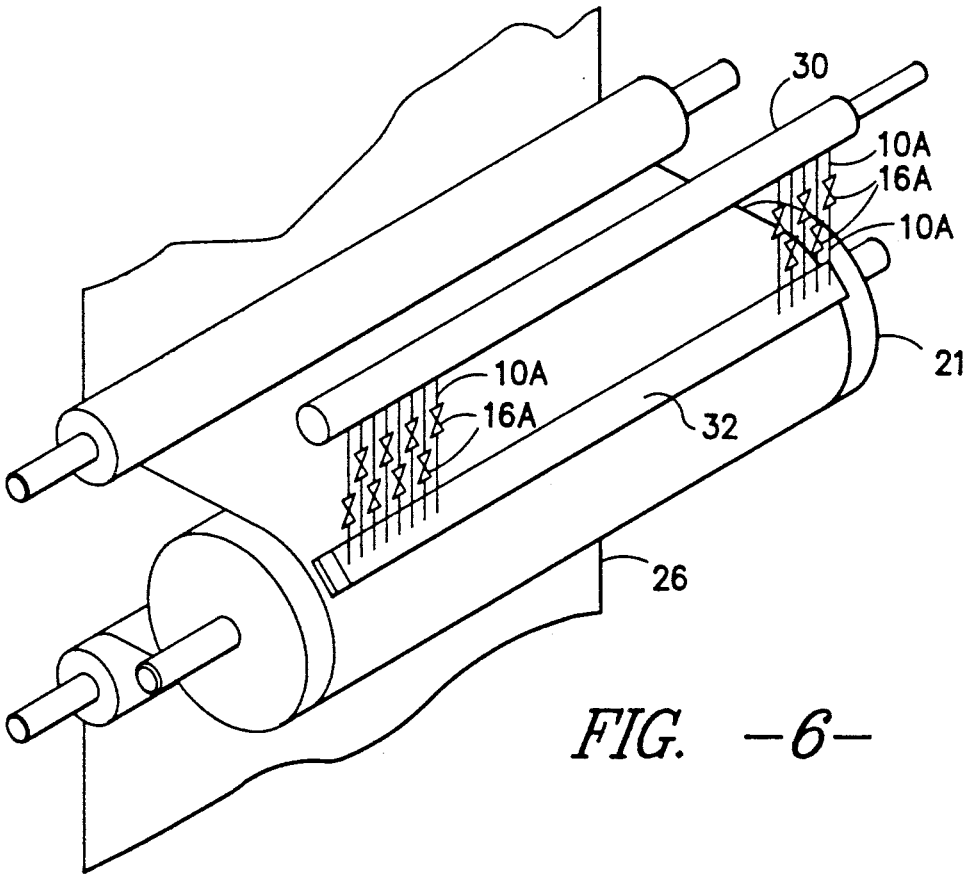
FIG. 6 is a diagrammatic perspective view of the apparatus of FIG. 5.
Figure 7:
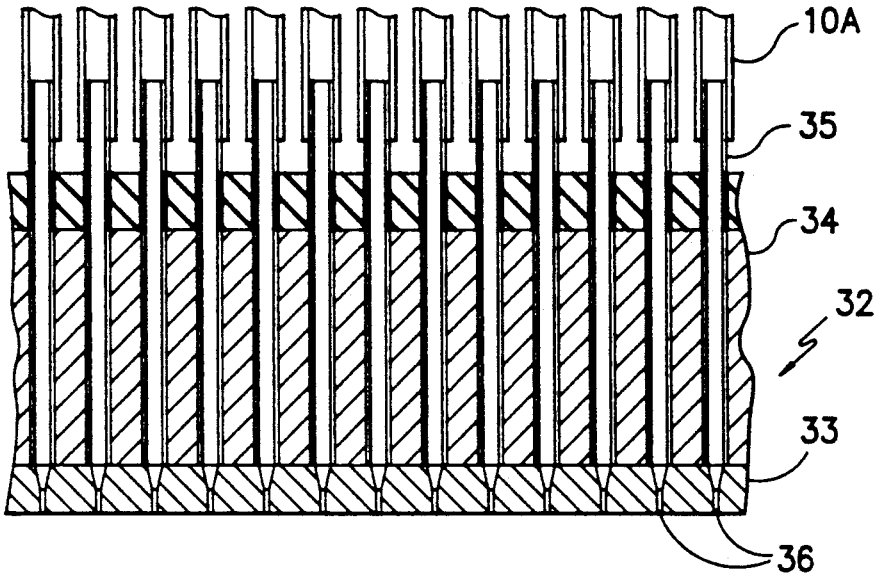
FIG. 7 is a section view of an orifice assembly suitable for use in the apparatus of FIGS. 5 and 6.

As depicted in FIGS. 5 through 7, a multiple jet array orifice assembly 32 is situated in close proximity to the surface of fabric web 26, as web 26 passes over roll 21. Array assembly 32 may be sufficiently wide to extend entirely across web 26, or may comprise a fraction of the width of web 26. In the latter case, a traversing table or other means may be used, as discussed above, to obtain full-width coverage. Associated with each orifice in array assembly 32, and situated in a corresponding conduit 10A, is a separate remotely actuatable valve, designated at 16A, which serves to interrupt or control the stream of high velocity fluid emanating from its respective orifice in array assembly 32. As before, these valves can be of any suitable kind, e.g., electrical, pneumatic, etc., and may be installed in any satisfactory conventional manner which will allow safe and positive control of the pressurized fluid. Inserted between pump 8 and the array of valves 16A is a hydraulic accumulator or ballast tank 30. By using such tank 30, pump 8 may be specified at a somewhat smaller capacity than would otherwise be the case. Peak, short term demands for high pressure liquid, as when all jets are firing for a given short period of time, may be met by the capacity stored or accumulated in tank 30. FIG. 7 depicts a section view of array assembly 32, taken perpendicular to the surface of roll 21 and bisecting the orifices in assembly 32. Orifice block 34 is drilled and fitted with tubes 35 which extend beyond block 34 and which are securely connected with respective supply conduits 10A. Orifice plate 33 is drilled with converging passages 36 which form collectively an array of jets.

Figure 8:
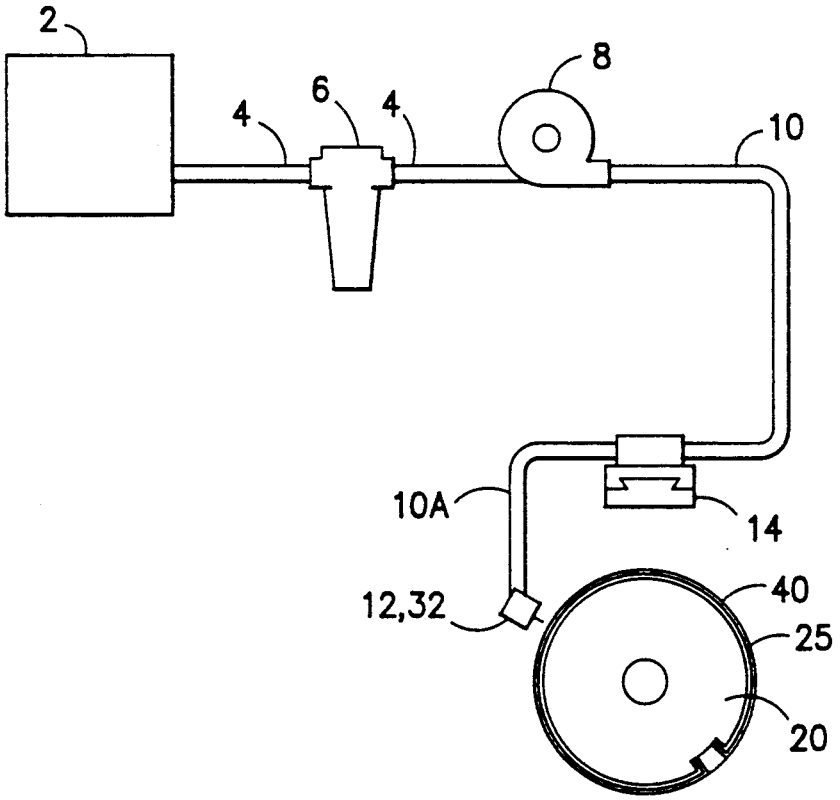
FIG. 8 is a schematicized side view of an apparatus for generating the fabric of the instant invention wherein a pre-cut section of fabric is patterned by a traversing liquid jet situated opposite a stencil which is interposed between the jet and the fabric surface.

In another embodiment of this invention, depicted in FIG. 8, a stencil is interposed between a single jet or an array of jets and the fabric 25 to interrupt the liquid stream, in place of the valves disclosed above. In the form shown in FIG. 8, a sleeve-type stencil 40, comprised of stainless steel, suitable plastic, or other suitable material which serves to mask areas of the fabric which are not to be treated, is placed in fixed relationship over the fabric segment 25 which is attached to roll 20. If desired, a traversing means 14 may be used to move the high velocity fluid jet or jets formed at assembly 12 or 32 across the face of the stencil 40 as the stencil and fabric are rotated together on roll 20. If a sufficiently wide multiple jet array is used, traversing means 14 is unnecessary. The fluid streams directly contact the fabric only where permitted by apertures in the stencil 40.

Figure 9:
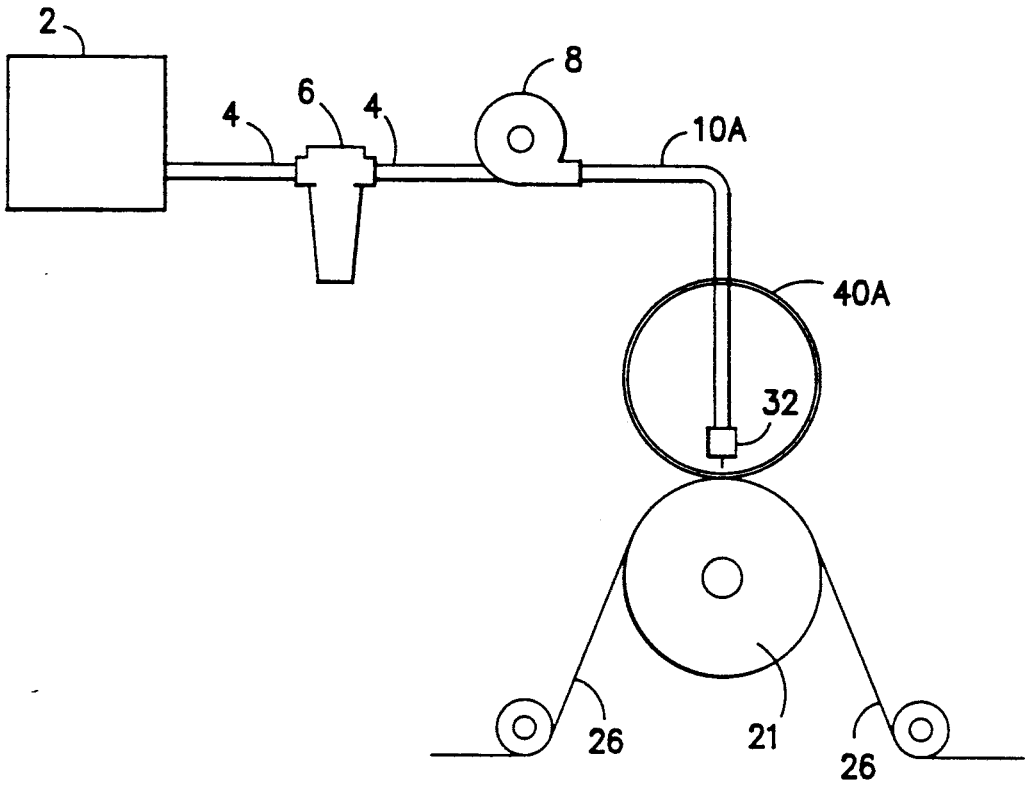
FIG. 9 is a schematicized side view of an apparatus for generating the fabric of the instant invention wherein an array of liquid jets is placed inside a stencil in the form of a cylinder, which in turn is brought into close proximity to the fabric surface.
Figure 10:
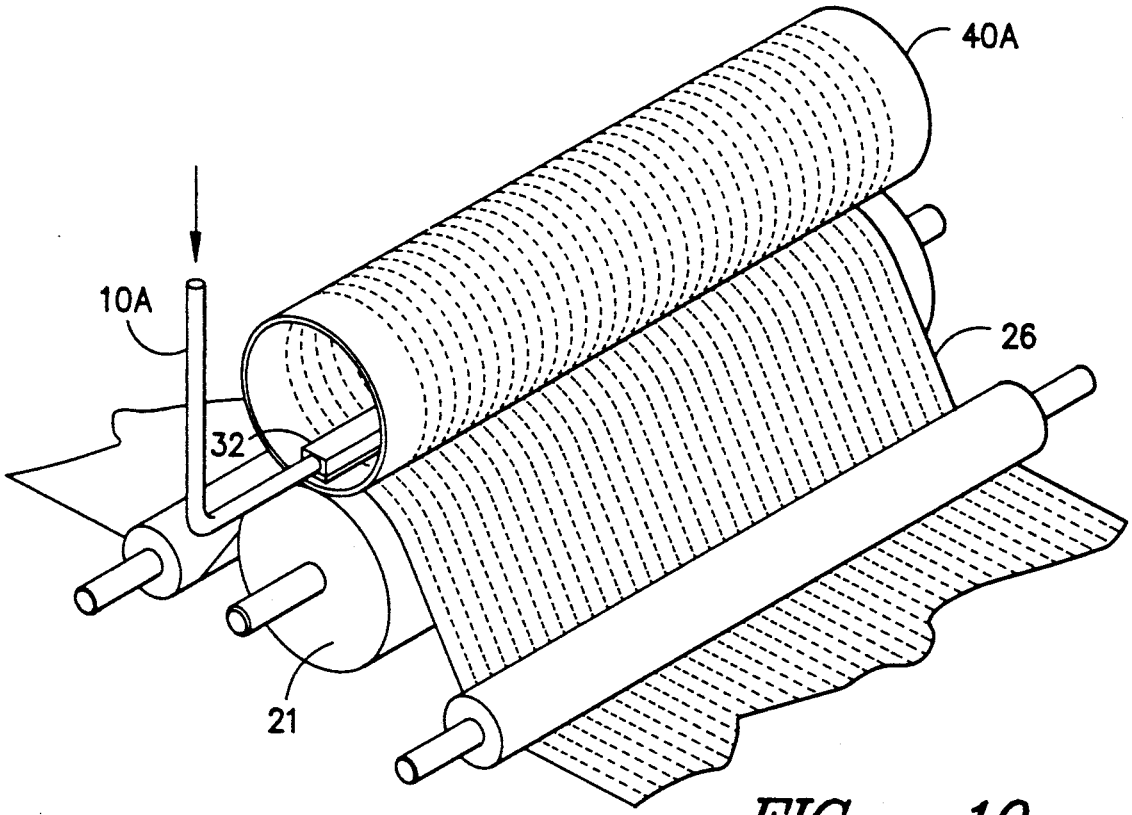
FIG. 10 is a diagrammatic perspective view of the apparatus of FIG. 9.

In an alternative and preferred stencil embodiment, the stencil is configured to allow the fabric to be patterned to be in the form of a moving web. FIGS. 9 and 10 show a configuration whereby a cylindrical stencil 40A is arranged to accommodate a multiple jet array orifice assembly such as shown at 32 within the stencil 40A. In this configuration, orifice assembly 32 preferably comprises an array of jets which extends across entire width of stencil 40A, which in turn extends across the entire width of fabric web 26. Orifice assembly 32 is preferably located in close proximity to the inside surface of cylindrical stencil 40A; the outer surface of stencil 40A is preferably located in close proximity to, and perhaps in direct contact with, the surface of fabric web 26. Means, not shown, are provided to achieve smooth rotation of stencil 40A in synchronism with the movement of fabric web 26. This may be achieved, for example, by an appropriate gear train operating on a ring gear which is associated with one or both ends of cylindrical stencil 40A.

It is also contemplated that a single or multiple jet array may be used which is made to traverse within cylindrical stencil 40A so that the entire width of fabric web 26 may be treated. Use of such traversing jet or jet array would preferably require incremental movement of fabric web 26, as discussed above.

Certain other approaches for selectively interrupting or otherwise controlling the impact of one or more streams of high velocity liquid on the fabric surface in response to pattern information have also been proposed by others skilled in the art, and may be used to generate the products contemplated herein. This apparatus, even though invented by another, is presented hereinbelow in the interest of disclosing other useful and potentially preferable approaches by which the teachings of may invention may be implemented.

Where an array of high velocity jets may be individually controlled in response to pattern information, the apparatus shown in FIGS. 11 through 17, may be employed.

Figure 11:
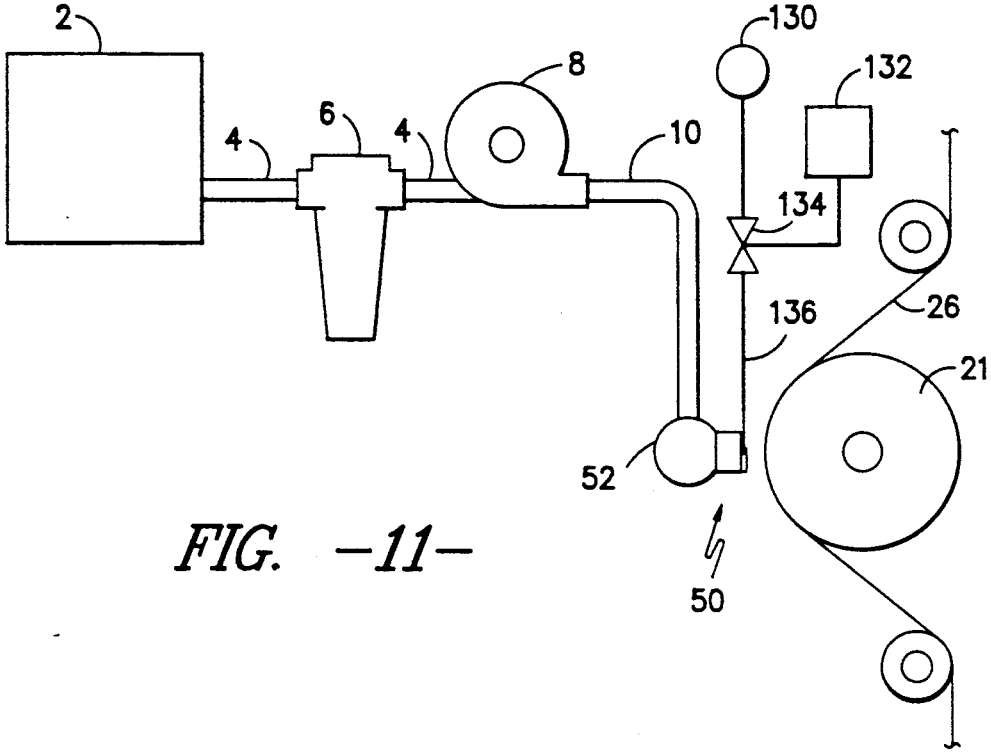
FIG. 11 is an overview of yet another apparatus which may be used to generate the novel products disclosed herein.

FIG. 11 depicts an overall view of an apparatus designed to use a combination manifold/stream forming/-stream interrupting apparatus 50, which is depicted in more detail in FIGS. 12 through 17. Pump 8 is used to pump, via suitable conduits 4, 10, a working fluid such as water from a suitable source of supply 2 through an appropriate filter 6 to a high pressure supply duct 52, which in turn supplies water at suitable dynamic pressure (e.g., between 300 p.s.i.g. and 3,000 p.s.i.g.) to the manifold apparatus 50. Also depicted in FIG. 11 are the conduits 136 for directing the control fluid, for example, slightly pressurized air as supplied from source 130, and valves 134 by which the flow of control fluid may be selectively established or interrupted in response to pattern information supplied by pattern data source 132. As will be explained in greater detail hereinbelow, establishing the flow of control fluid to manifold apparatus 50 via conduits, 136, pressurized no higher than approximately one-twentieth of the pressure of the high velocity water, causes an interruption in the flow of high velocity water emanating from manifold apparatus 50 and striking the substrate placed against backing member 21. Conversely, interrupting such control fluid flow causes the flow of high velocity water to impact the substrate 26 placed against backing member 21.

Figure 12:
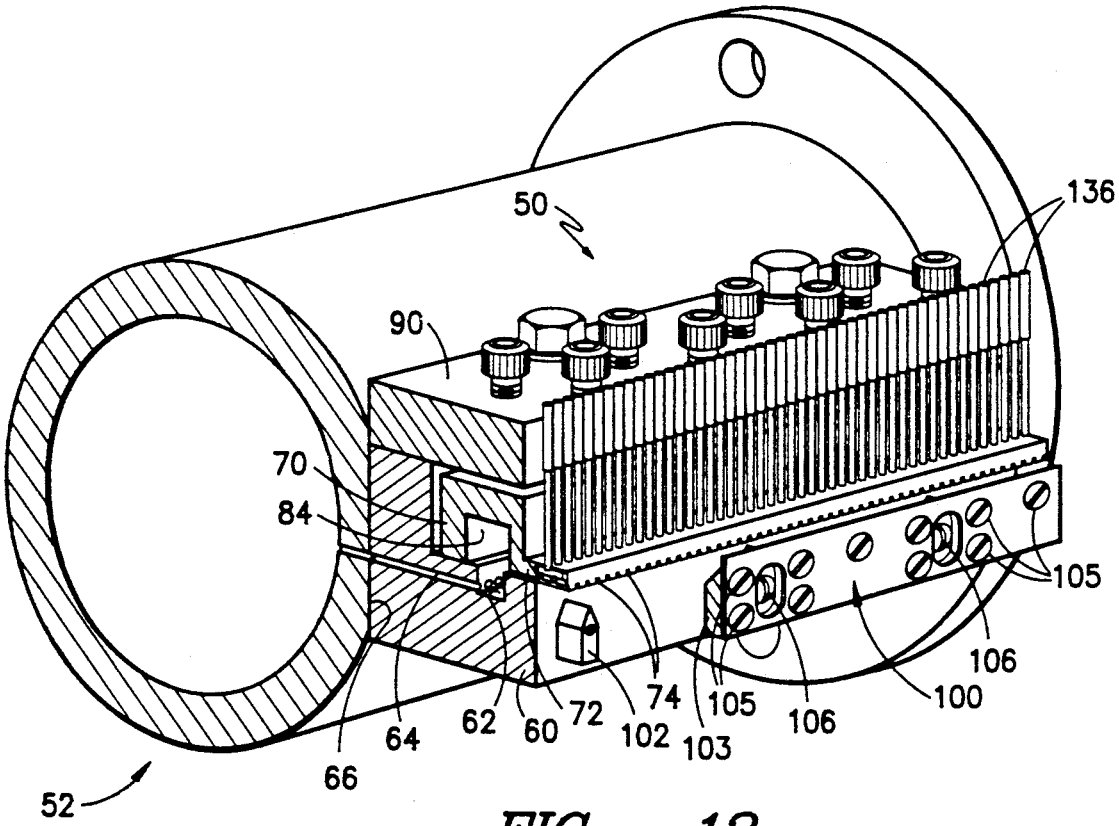
FIG. 12 is a perspective view of the high pressure manifold assembly depicted in FIG. 11.
Figure 13:
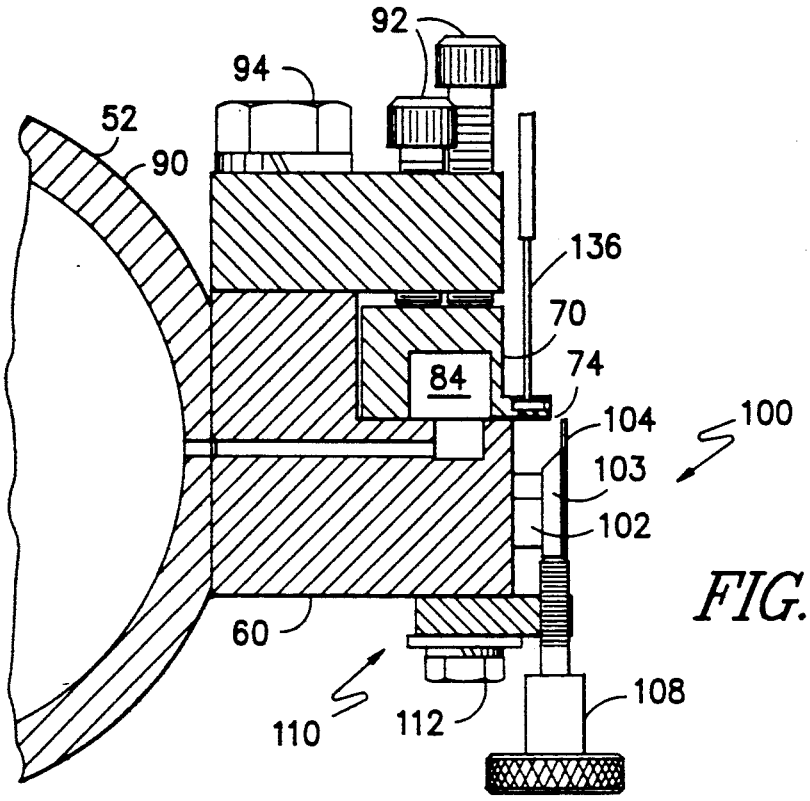
FIG. 13 is a side view of the assembly of FIG. 12, showing the alignment means used to align the containment plate depicted in FIG. 12.

Looking to FIG. 12, it may be seen that manifold assembly 50 is comprised of five basic structures: high pressure supply gallery assembly 60 (which is mounted in operable association with high pressure supply duct 52), grooved chamber assembly 70, clamping assembly 90, control fluid conduits 136, and spaced barrier plate assembly 100.

Supply gallery assembly 60 is comprised of an "L"-shaped member, into one leg of which is machined a uniform notch 62 which extends, uninterrupted, along the entire length of the assembly 50. A series of uniformly spaced supply passages 64 are drilled through the side wall 66 of assembly 60 to the corresponding side wall of notch 62, whereby notch 62 may be supplied with high pressure water from high pressure supply duct 52, the side of which may be appropriately milled, drilled, and connected to side wall 66 and the end of respective supply passages 64. Slotted chamber assembly 70 is comprised of an elongate member having an inverted hook-shaped cross-section, and having an extending leg 72 into which have been machined a series of closely spaced parallel slots or groves 74 each having a width approximately equal to the width of the desired high velocity treatment stream, and, associated with each slot, a series of communicating control fluid passages, shown in greater detail in FIGS. 14 through 17. These control passages are connected to control fluid conduits 136, through which is supplied a flow of low pressure control fluid during those intervals in which the flow of high pressure fluid flowing through slots 74 is to be interrupted.

As shown in FIGS. 14 through 17, the control fluid passages are comprised of a pair of slot intercept passages 76 spaced along the base of each slot and connected to an individual elongate chamber 78 which is aligned with the axis of its respective slot 74. Each slot 74 has associated with it a respective chamber 78, which in turn is connected, via respective individual control supply passages 80, to a respective control fluid conduit 136. In practice, chambers 78 may be made by drilling a passage of the desired length from the barrier plate (104) side of chamber assembly 70, then plugging the exit hole in a manner appropriate to contain the relatively low pressure control fluid.

Figure 14:
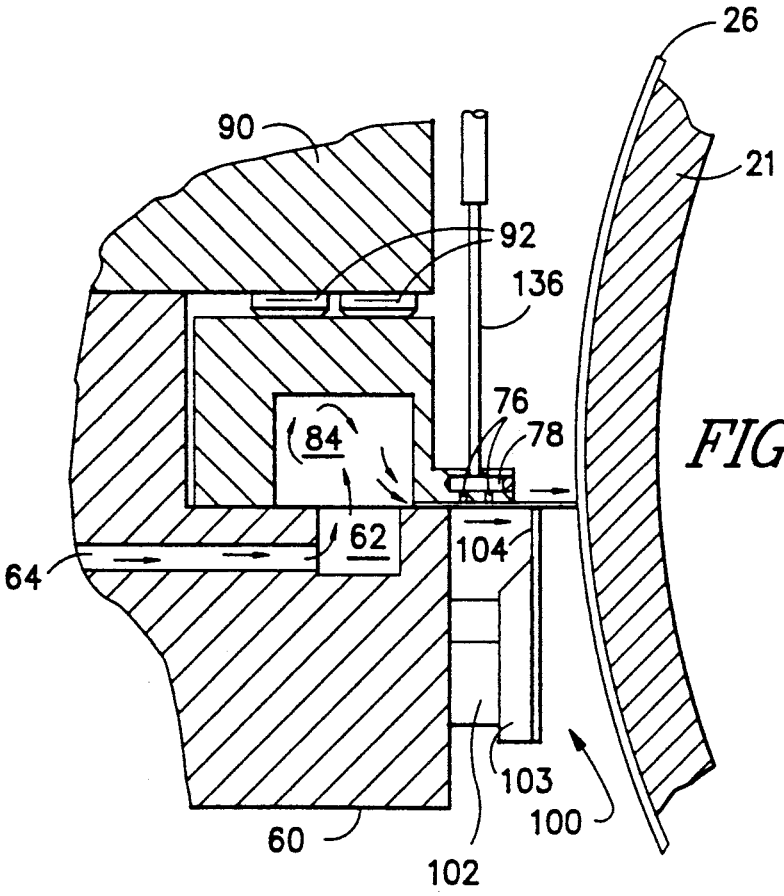
FIG. 14 is a cross-section view of the assembly of FIG. 12, without the alignment means, showing the path of the high velocity fluid through the manifold, and the path of the resulting fluid stream as it strikes a substrate placed against the support roll.
Figure 15:
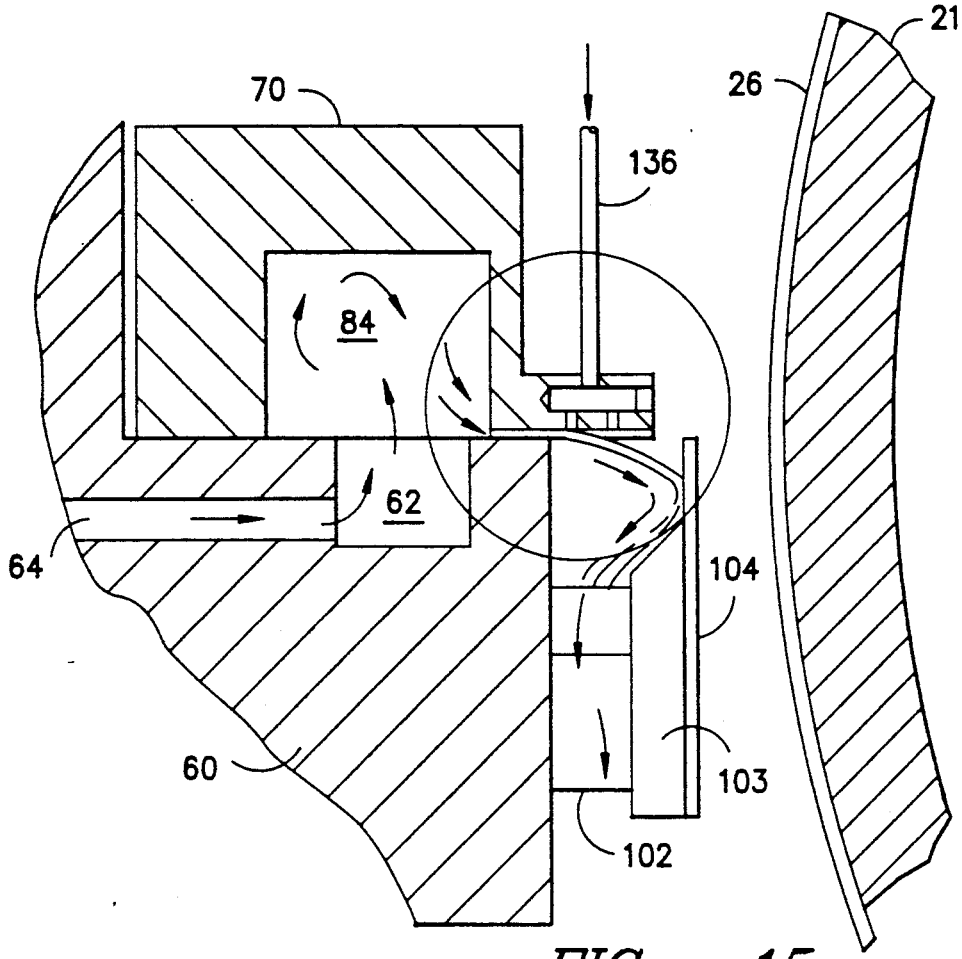
FIG. 15 depicts a portion of the view of FIG. 14, but wherein the fluid stream is prevented from striking the target substrate by the deflecting action of a stream of control fluid.

Grooved chamber assembly 70 is positioned, via clamping assembly 90, within supply gallery assembly 60 so that its "C"-shaped chamber is facing notch 62, thereby forming a high pressure distribution reservoir chamber 84 in which, as depicted in FIGS. 14 and 15, high pressure water enters notch 62 via passages 64, enters reservoir chamber 84, and flows through slots 74 towards the substrate 26. Clamping assembly 90 is provided along its length with jacking screws 92 as well as bolts 94 which serve to securely attach clamping assembly 90 to supply gallery assembly 60 along the side opposite barrier plate assembly 100. It is important to note that the configuration and placement of slotted chamber assembly 70 provides for slots 74 to be entirely covered over the portion of slots closest to reservoir chamber 84, but provides for slots 74 to be uncovered or open over the portion of slots nearest barrier plate assembly 100, and particularly over that portion of the slots 74 opposite and immediately downstream of slot intercept passages 76.

Associated with supply gallery assembly 60 and attached thereto via tapered spacing supports 102 is spaced barrier plate assembly 100, comprising a rigid plate 104 having an edge which is positioned to be just outside the path of the high velocity stream as the stream leaves the confines of slot 74 and exits from the end of chamber assembly 70, and crosses the plane defined by plate 104. To ensure rigidity of plate 104, elongate backing plate 103 is securely attached to the inside surface of plate 104, via screws 105 positioned along the length of plate 104. Screws 106, which thread into threaded holes in spacing supports 102, are used to fix the position of plate 104 following alignment adjustment via threaded alignment bolts 108. Bolts 108 are associated with alignment guide 110 which is, at the time of machine set up, attached to the base of supply gallery assembly 60 via screws 112. By turning bolts 108, precise and reproducible changes in the relative elevation of plate 104, and thereby the clearance between the distal or upstanding edge of plate 104 and the path of the high velocity fluid jet(s), may be made. After the plate 104 is brought into satisfactory alignment relative to slots 74, screws 106 may be tightened and alignment guide 110, with bolts 108, may be removed, thereby fixing the edge of plate 104 in proper relation to the base of slots 74.

FIGS. 14 and 15 depicts a fluid jet(s) impacting the substrate 26 perpendicular to the plane of tangency to the surface of support roll 21 at the point of impact; in some cases, however, it may be advantageous to direct the fluid jet(s) at a small angle relative to such plane, in either direction (i.e., either into or along the direction of rotation of roll 21). Generally, such angles (hereinafter referred to as "inclination angles") are about twenty degrees or less, but may be more for some applications.

As depicted in FIG. 15, when no control fluid is flowing through conduit 136 and slot intercept passages 76, highly pressurized water from passages 64 fills high pressure reservoir chamber 84 and is ejected towards substrate 26, via slots 74, in the form of a high velocity stream which passes in close proximity to the distal or upstanding edge of barrier plate 104. The high velocity streams are formed as the high pressure water is forced through the passages formed by covered portions of slots 74; the streams retain substantially the same cross section as they travel along the uncovered portion of slots 74 between supply gallery assembly 60 and barrier plate 104, diverging only slightly as they leave the confines of the slots 74, pass the upstanding portion of barrier plate 104, and strike the substrate 26.

Figure 16:
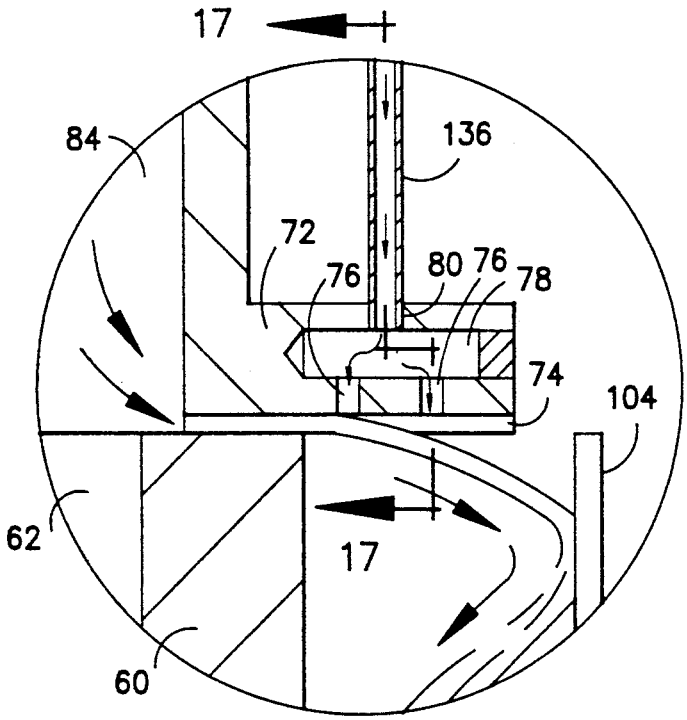
FIG. 16 is an enlarged, cross-section view of the encircled portion of FIG. 15.

As depicted in FIGS. 15 and 16, when a "no treatment" signal is sent to a valve controlling the flow of control fluid in a given conduit 136, a relatively low pressure control fluid, e.g., air, is made to flow from the selected conduit 136 into the associated slot intercept passages 76 of a given slot 74, and the high velocity stream traveling along that slot is subjected to a force directed to the open side of the slot 74. Absent a counteracting force, this relatively slight pressure introduced by the control fluid causes the selected high velocity stream to leave the confines of the slot 74 and strike the barrier plate rather than the substrate, where its energy is dissipated, leaving the substrate untouched by the energetic stream. In a preferred embodiment of the apparatus, a separate electrically actuated air valve such as the Tomita Tom-Boy JC-300, manufactured by Tomita Co., Ltd., No. 18-16 1 Chome, Ohmorinaka, Ohta-ku, Tokyo, Japan, is associated with each control steam conduit. A valve actuating signal may be generated by conventional computer means, i.e., via an EPROM or from magnetic media, and routed to the respective valves, whereby the high velocity treatment streams may be selectively and intermittently actuated in accordance with supplied pattern data.

Figure 17:
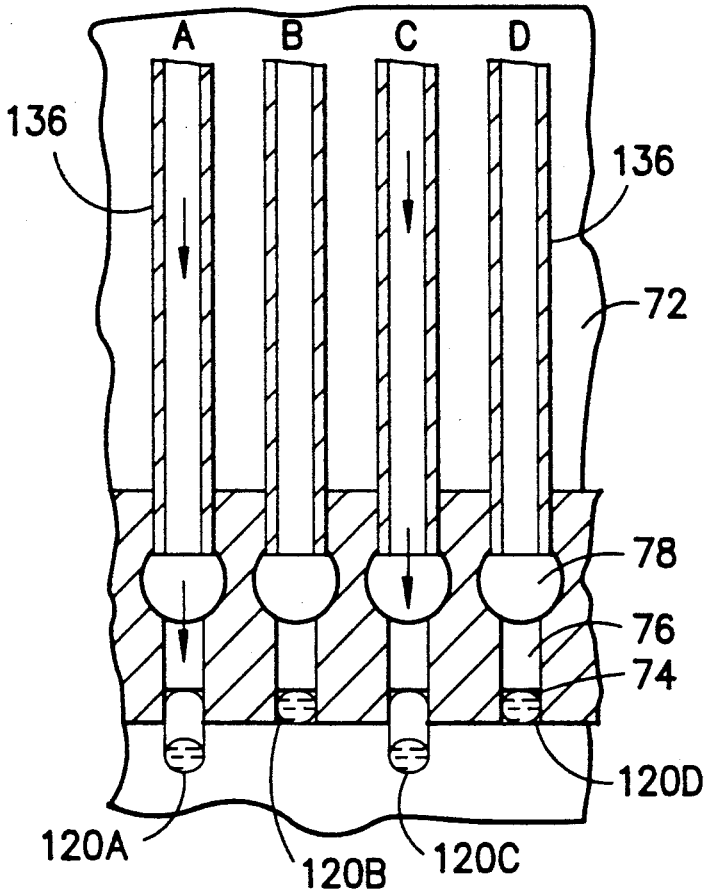
FIG. 17 is a cross-section view taken along lines XVII—XVII of FIG. 16, depicting the deflection of selected working fluid jets by the flow of control fluid.
Figure 18:
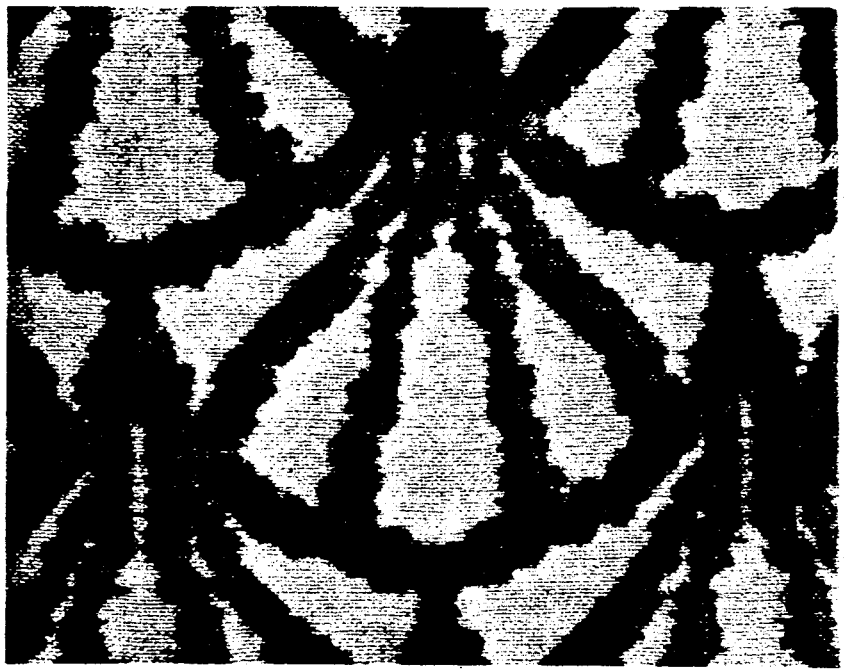
FIGS. 18 and 19 are photomicrographs (1.1x) of the face and back, respectively, of the patterned fabric of Example 1.
Figure 19:
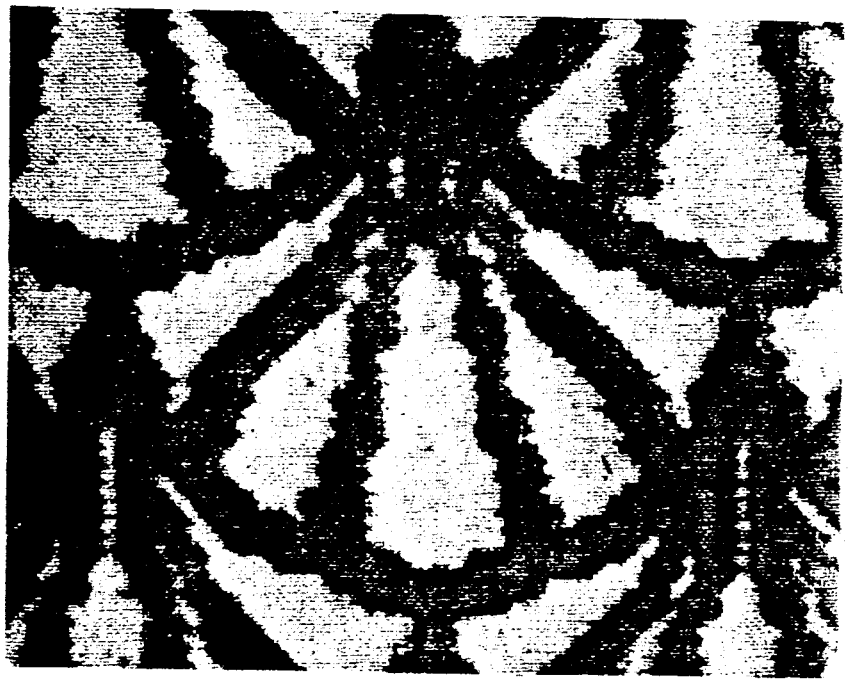
Figure 20:
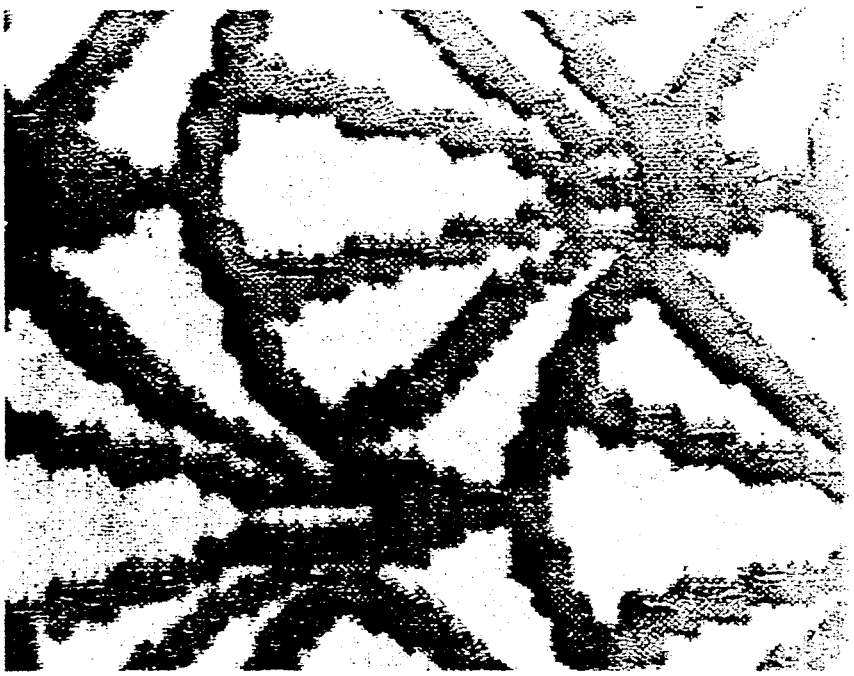
FIG. 20 is a reflected light photomicrograph (1.1x) of the face of the fabric of Example 1.
Figure 21:
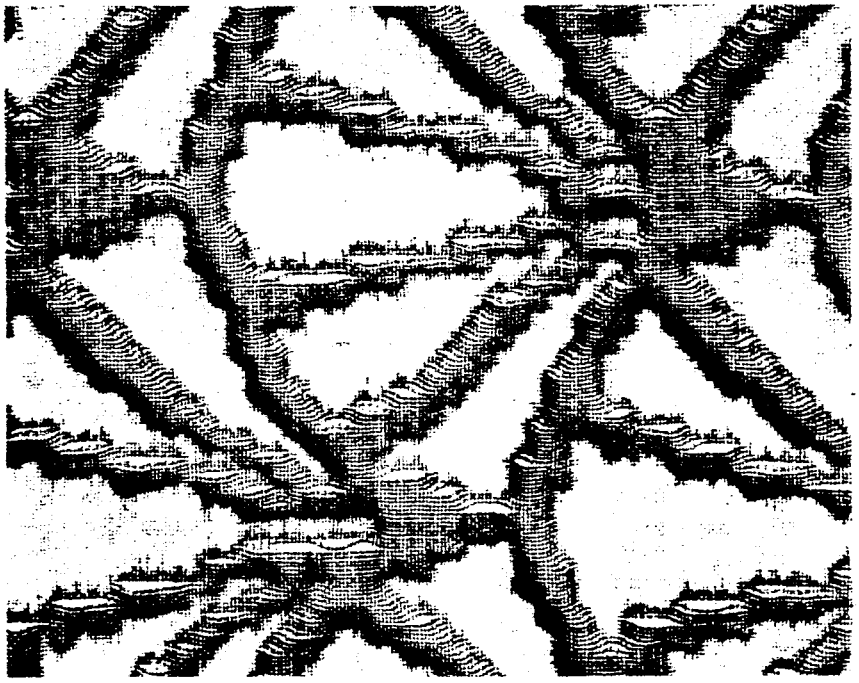
FIG. 21 is a transmitted light photomicrograph (1.1x) of the face of the fabric of Example 1.

FIG. 17 is a section view taken through lines XVII—XVII of FIG. 16, and diagrammatically indicates the effects of control fluid flow in conduits 136. As indicated, low pressure control fluid is flowing in control stream conduits 136 identified as "A" and "C", while no control fluid is flowing conduits 136 identified as "B" and "D". In conduits "A" and "C", the high velocity jets 120A and 120C, respectively, have been dislodged from the lateral walls of slots 74 and are being deflected on a trajectory which will terminate on the inner surface of barrier plate 104. In contrast, no control fluid is flowing in conduits 136 identified as "B" and "D"; as a consequence, the high velocity jets 120B and 120D, laterally defined by the walls of slots 74, are on a trajectory which will avoid the upstanding edge of barrier plate 104 and terminate on the surface of roll 21, or substrate 26 supported thereby.

The following examples demonstrate, without intending to be limiting in any way, the method by which fabrics of the present invention may be generated.

EXAMPLE 1

A fabric consisting of a one hundred per cent (100%) polyester 1×1 plain weave was first desized, scoured, mercerized, and bleached. It was then padded with a fluorocarbon water repellent material, in accordance with recommended practice, and dried. The fluorocarbon material used was Scotchguard FC831, marketed by Minnesota Mining and Manufacturing Company of St. Paul, Minn. An apparatus similar to that depicted in FIGS. 11 through 17 was used. The water pressure was maintained at 600 p.s.i.g., the control fluid was air, which was varied in pressure from 2 to 70 p.s.i.g. in response to externally supplied pattern information. At control fluid pressures on the order of 2 p.s.i.g., the water streams remained uninterrupted. The fabric was positioned approximately 0.37 inch from the exit apertures of slots 74. Circumferential roll speed was five yards per minute. The fabric was then padded with a conventional aqueous disperse dye and heated, in a conventional manner, to set or fix the dye. The dye was able to overcome the hydrophobic treatment and wet the fabric only in those areas where the fabric had been and remained wetted by the high velocity water streams. In other areas, the aqueous dye was unable to penetrate the fibers, and little dyeing took place. The resulting patterned fabric is shown in FIGS. 18 through 21.

The dyed pattern is apparent on both the front and the back of the fabric, but is somewhat more pronounced on the side of the fabric which was closest to the high velocity water streams. Some shifting of the warp yarns of the fabric within the dyed pattern area is apparent.

EXAMPLE 2

A one hundred per cent (100%) cotton broadcloth fabric was desized, scoured, mercerized and bleached.

It was then padded with a fluorocarbon water repellent as in Example 1 and dried. A pattern was then imparted to the fabric by selectively wetting out the fabric with a high velocity water jet, as in Example 1. The resulting selectively wetted fabric was then padded with a conventional fiber reactive cotton dye and sodium hydroxide. It was wrapped in polyethylene and aged at room temperature for 4 hours. Then it was rinsed and dried. The resulting fabric exhibited excellent dyed patterning in the treated (i.e., wetted) areas, and showed little dye pick-up in the untreated areas.

EXAMPLE 3

A nylon/lycra warp knit fabric was padded with a fluorochemical water repellent and dried. It was then selectively wetted as in Example 1 and dyed at a low temperature (140° F.) in a jet dyeing machine using a conventional acid dye. The resulting fabric exhibited excellent dyed patterning in the treated (i.e., wetted) areas, and showed little dye pick-up in the untreated areas.

Figure 22:
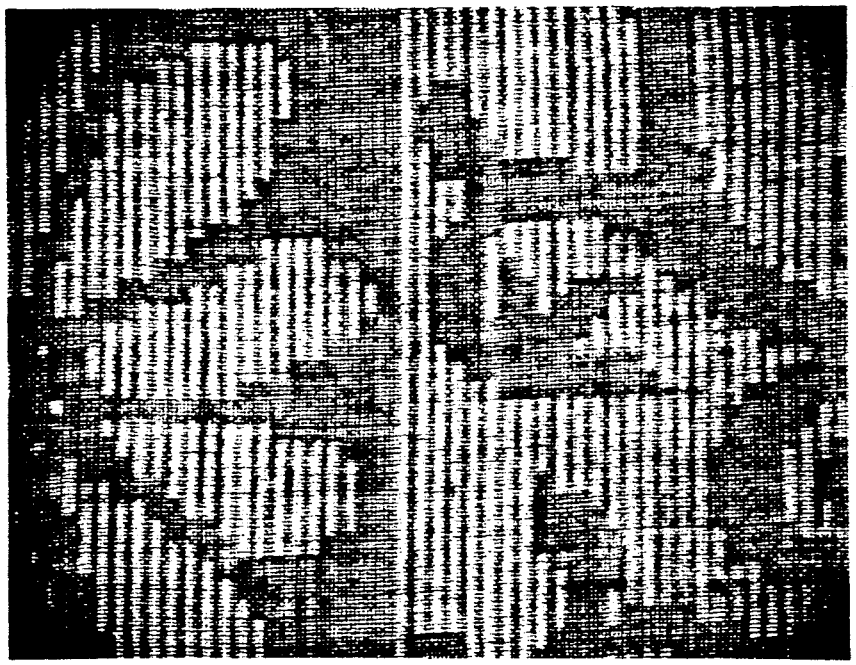
FIGS. 22 through 25 are transmitted light photomicrographs (1.1x) of the face of a fabric patterned with water only, in accordance with the teachings herein.
Figure 23:
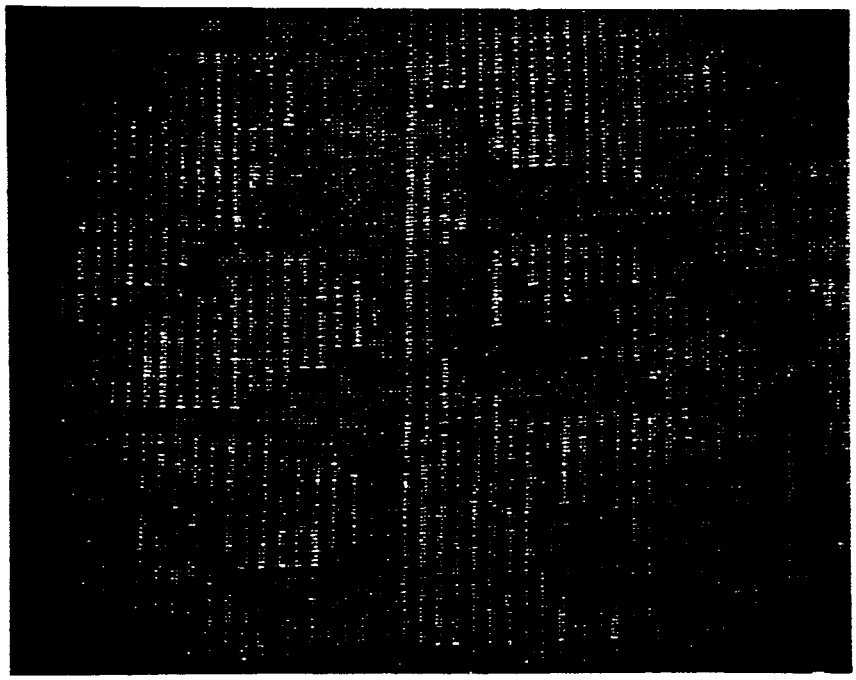
Figure 24:
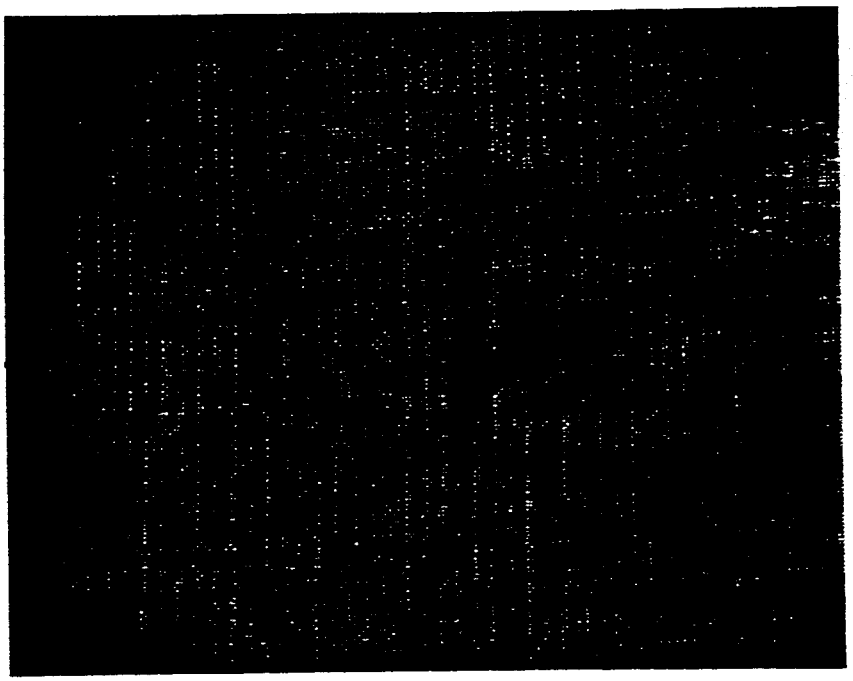
Figure 25:
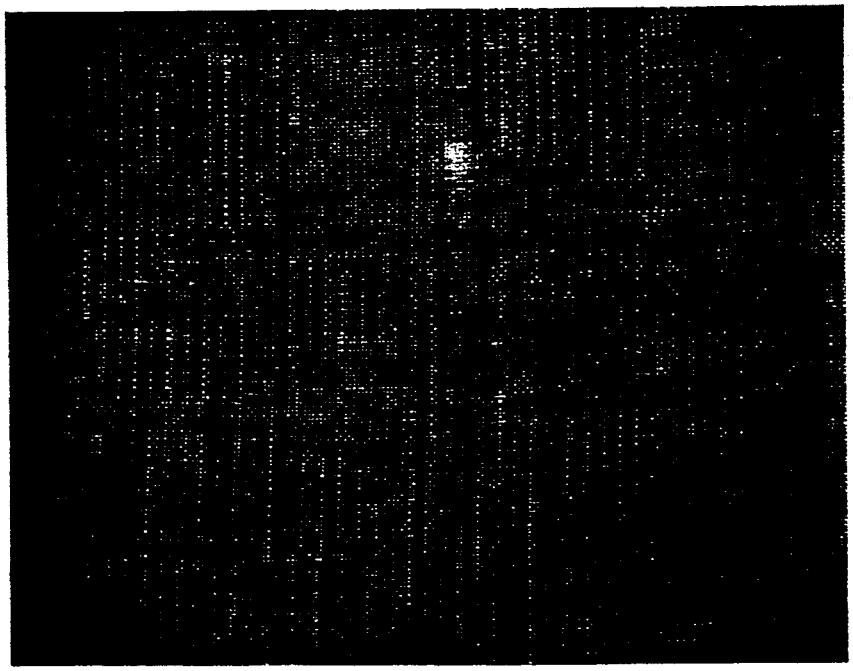

It is believed that the mechanism by which the dyed pattern is generated involves the temporary neutralization or overcoming of the hydrophobic or anti-wetting characteristics of the finish applied to the surface of the starting fabric in those areas impacted by the water streams. It is thought that the high velocity water stream "forces" the fabric yarns to wet in the areas of impact by overcoming the water repelling nature of the hydrophobic coating, and also perhaps removes a portion of the coating in the areas of stream impact, thereby possibly lowering the threshold at which the fabric can be made to wet. The wetting of the fabric in the stream impact areas may be seen clearly in FIGS. 22 through 25, which show the progressive drying of a fabric subjected to a high velocity water stream treatment as disclosed herein, as seen using transmitted light. No dye was used, the pattern shown instead being generated merely by the wetting of the yarns in the stream impact areas. FIG. 22 was taken immediately after a treated and dried sample of fabric was wet by placing the sample under a gentle stream of faucet water; FIGS. 23, 24, and 25 show the same fabric twenty, fifty, and sixty minutes after wetting. As can be seen, the water defines the pattern on the fabric; the pattern becomes less and less apparent as the water in the wetted areas of the fabric evaporates. As depicted in FIG. 25 (i.e., after sixty minutes), the only pattern indicator after the water has evaporated is the warp yarn shift caused by the high velocity water streams.

Figure 26:
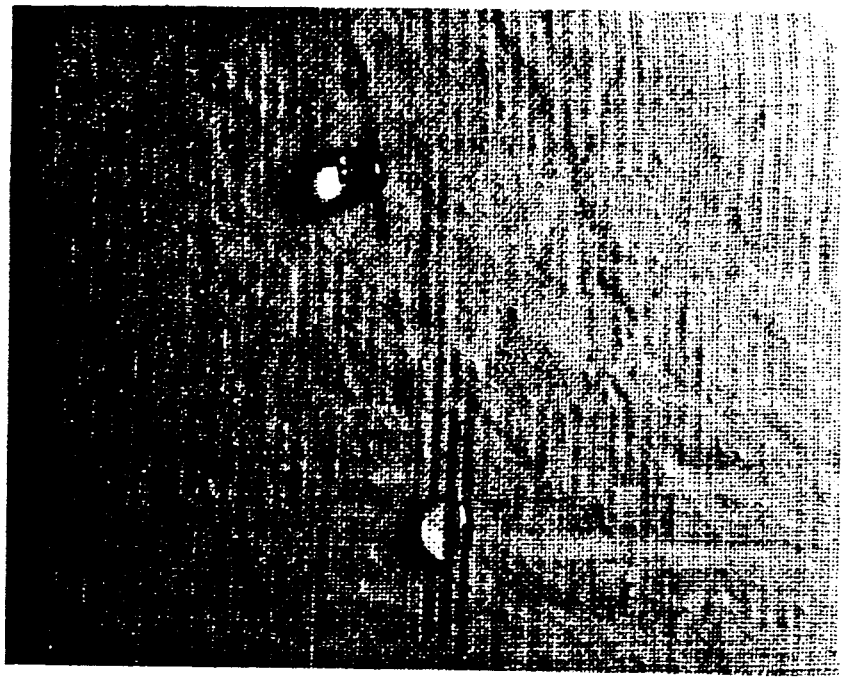
FIGS. 26 and 27 are reflected and transmitted light photomicrograph (1.1x), respectively, of the face of the dry fabric of FIGS. 22 through 25, supporting a water droplet in both the patterned (lower droplet) and unpatterned (upper droplet) areas, indicating the continuing water repellency of the treated areas of the fabric.
Figure 27:
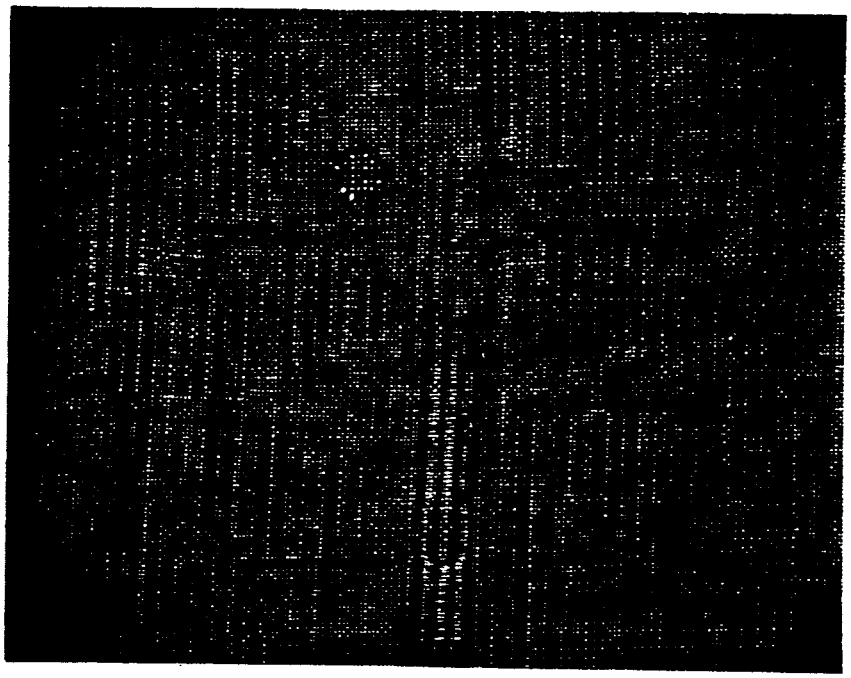

The degree of water-repellent removal by the high velocity streams is not believed to be sufficient to remove the water-repelling nature of the fabric under ordinary wearing apparel conditions. As shown in FIGS. 26 and 27, which show reflected and transmitted light views, respectively, of the dry fabric of FIG. 25, water applied to both patterned (lower droplet) and unpatterned (upper droplet) areas forces the water to bead in both instances; in the patterned (i.e., stream-impacted) area, however, the water forms an elliptical rather than a circular bead, with the long axis of the ellipse lying along the track of the stream-impacted area.

The resulting textile products exhibit a distinctive "batik" dyed appearance, yet have the general water-repellent character associated with fabrics treated with Scotchguard or other water-repellent treatments, thereby avoiding additional post-process treatments with hydrophobic agents and minimizing production costs.

As this invention may be embodied in several forms without departing from the spirit or essential character thereof, the embodiments presented herein are intended to be illustrative and not descriptive. The scope of the invention is intended to be defined by the following appended claims, rather than any descriptive matter hereinabove, and all embodiments of the invention which fall within the meaning and range of equivalency of such claims are, therefore, intended to be embraced by such claims.

I claim:

1. A process for dyeing selected areas of the surface of a textile fabric with an aqueous dye to form a pattern thereon, said process comprising the steps of:

(a) providing a substantially dry fabric having a surface which carries a water-insoluble composition, said composition imparting a substantially uniform hydrophobic character to said fabric surface;

(b) directing a stream of high velocity water to selected areas of said fabric surface comprising said pattern, said water stream having sufficient velocity to overcome said hydrophobic character of said fabric surface and wet said fabric surface in said selected areas, said fabric surface remaining substantially non-wetted elsewhere;

(c) contacting said fabric surface with an aqueous dye, whereby said dye substantially wets and is retained by said fabric only in said selected areas already wetted by said water stream, and is repelled by said hydrophobic character of said non-wetted fabric surface elsewhere;

(d) fixing said dye retained by said fabric in said wetted areas.

2. The process of claim 1 wherein said fabric is a woven fabric, and wherein said water stream displaces warp yarns within said selected areas.

3. The process of claim 1 wherein said water stream removes a portion of said water-insoluble composition in said selected areas.

4. The product of the process of claim 2.

5. The product of the process of claim 3.

6. A textile fabric having a surface carrying a dyed pattern thereon formed by an aqueous dye, said fabric having a water-insoluble hydrophobic composition distributed over said fabric surface in areas carrying said dyed pattern as well as areas adjacent to said dyed pattern areas, the concentration of said composition being substantially lower in areas of said surface containing said dye than in other areas of said surface, said other areas collectively having a substantially uniform concentration of said composition.

7. A woven textile fabric comprised of yarns extending in the warp direction and yarns extending in the fill direction, and having a surface carrying a dyed pattern thereon formed by an aqueous dye, said fabric having water-insoluble hydrophobic composition distributed over said fabric surface in areas carrying said dyed pattern as well as other areas adjacent to said dyed pattern areas, said other ares collectively having a substantially uniform concentration of said composition, and wherein said warp-direction yarns are displaced in at least portions of said areas carrying said dyed pattern with respect to warp-direction yarns in said other areas.

8. A textile fabric having a surface carrying a pattern thereon, said pattern being defined by areas of the surface of said fabric wetted by water which are adjacent to other areas of said surface which are not wetted by water, said fabric having a water-insoluble hydrophobic composition distributed over said fabric surface, including said wetted areas, and having a substantially uniform concentration of said composition in said other, non-wetted areas of said fabric.

* * * * *